US007299001B2

(12) United States Patent
Yamazaki

(10) Patent No.: US 7,299,001 B2
(45) Date of Patent: Nov. 20, 2007

(54) FUSER CLEANING METHOD AND SYSTEM IN IMAGE-FORMING DEVICE

(75) Inventor: Hajime Yamazaki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 31 days.

(21) Appl. No.: 10/938,911

(22) Filed: Sep. 10, 2004

(65) Prior Publication Data

US 2005/0100371 A1 May 12, 2005

(30) Foreign Application Priority Data

Sep. 12, 2003 (JP) ..... 2003-322143

(51) Int. Cl.
*G03G 15/20* (2006.01)

(52) U.S. Cl. ..... 399/327

(58) Field of Classification Search ..... 399/327
See application file for complete search history.

(56) References Cited

U.S. PATENT DOCUMENTS 5,528,346 A * 6/1996 Kim et al. ..... 399/33
5,850,588 A * 12/1998 Yoshikawa ..... 399/327
5,970,298 A * 10/1999 Seki et al. ..... 399/327
6,091,925 A * 7/2000 Sugimoto et al. ..... 399/327
6,181,890 B1 * 1/2001 Kataoka et al. ..... 399/67

FOREIGN PATENT DOCUMENTS

JP 07-104602 4/1995
JP 2000-075750 3/2000

* cited by examiner

*Primary Examiner*—David M. Gray
*Assistant Examiner*—Ruth N. LaBombard
(74) *Attorney, Agent, or Firm*—Knoble Yoshida & Dunleavy, LLC

(57) ABSTRACT

A fuser roller surface is cleaned immediately before and or after the fusing operation. The separate cleaning sequence assures that the fuser roller surface is substantially free from residual toner that has accumulated from previous fusing operation. A number of image-transfer sheets is counted, and the cleaning sequence is also optionally activated after a number of detected image-transfer sheets has reached a predetermined number.

19 Claims, 8 Drawing Sheets

FUSER CLEANING METHOD AND SYSTEM IN IMAGE-FORMING DEVICE

FIELD OF THE INVENTION

The current invention is generally related to a fuser or image-fixing unit in an image-forming apparatus, and more particularly related to a method of cleaning a fuser to substantially eliminate undesirable effects of residual toner on the fused image.

BACKGROUND OF THE INVENTION

In the prior art, a fuser or fixation unit usually fixes a toner image on an image-transfer sheet of paper by fusing rollers that have been heated. In the above fuser, since toner is not completely fixed on the transfer sheet, some toner remains on the fusing rollers. This remaining toner is also so called residual toner. The residual toner is collected from the fusing rollers by cleaning rollers via pressure rollers.

An image-transfer sheet is soiled by the residual toner in a prior art fuser. As described above, a portion of toner on the image-transfer paper becomes unfixed, and the residual toner is attached to a fuser separation pawl that separates the transfer paper from the fuser rollers. As the residual toner increases beyond a certain amount on the fuser separation pawl, aggregated toner falls from the fuser separation pawl and smears the transfer paper. Thus, the fuser separation pawl needs to be maintained. While the fuser separation pawl is periodically cleaned or replaced, the image forming device is not available.

For the above prior art problems, prior art techniques had attempted to minimize the undesirable effects. Japanese Patent Publication 2000-75750 discloses a cleaning blade for removing adherents such as toner from the cleaning rollers as well as a ceramic heater for heating the cleaning blade beyond a melting temperature of the residual toner. The ceramic heater adds structural complexities and requires additional costs. In relation to the prior art cleaning technologies of a fuser, Japanese Patent Publication Hei 7-104602 also discloses techniques for increasing the cleaning efficiency for the cleaning material in the fusing rollers in an image forming device and for uniformly applying oil. Although the cleaning rollers are located on the transfer paper outlet side of the fusing rollers, the residual toner that has been cleaned by the cleaning rollers falls off onto the transfer sheet for undesirable effects.

It remains desirable to maintain the fuser rollers substantially free from residual toner without significant structural modifications to the fuser or fixing unit.

SUMMARY OF THE INVENTION

In order to solve the above and other problems, according to a first aspect of the current invention, a method of cleaning a fuser in an image-forming device, including the steps of: anticipating a print operation in the image-forming device to generate a print preparation command; cleaning residual toner from the fuser in response to the print preparation command prior to forming an image on an image-transfer sheet in the image-forming device by intermittently activating and deactivating for a predetermined number of times to rotate a fuser roller in the fuser and collecting the residual toner; forming the image on the image-transfer sheet; and fusing the image on the image-transfer sheet at a first predetermined temperature.

According to a second aspect of the current invention, a system for cleaning a fuser in an image-forming device, including: a fuser for fusing an image on an image-transfer sheet at a first predetermined temperature; a user information access unit for obtaining a predetermined set of information to anticipate a print operation in the image-forming device so as to generate a print preparation command; a control unit connected to th user information access unit and the fuser for controlling a cleaning sequence for cleaning residual toner from the fuser in response to the print preparation command prior to fusing an image on an image-transfer sheet in the fuser, the control unit generating a cleaning complete signal upon finishing the cleaning seguence; a writing unit connected to the control unit for forming the image on the image-transfer sheet in response to the cleaning complete signal, wherein the fuser fuses the image on the image-transfer sheet after the cleaning sequence, wherein the fuser further includes a fuser roller, the control unit activating and deactivating the fuser for a predetermined number of times for intermittently rotating the fuser roller in the fuser in order to collect the residual toner.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Based upon incorporation by external reference, the current application incorporates all disclosures in the corresponding foreign priority document (JP2003-322143) from which the current application claims priority.

Figure 1:
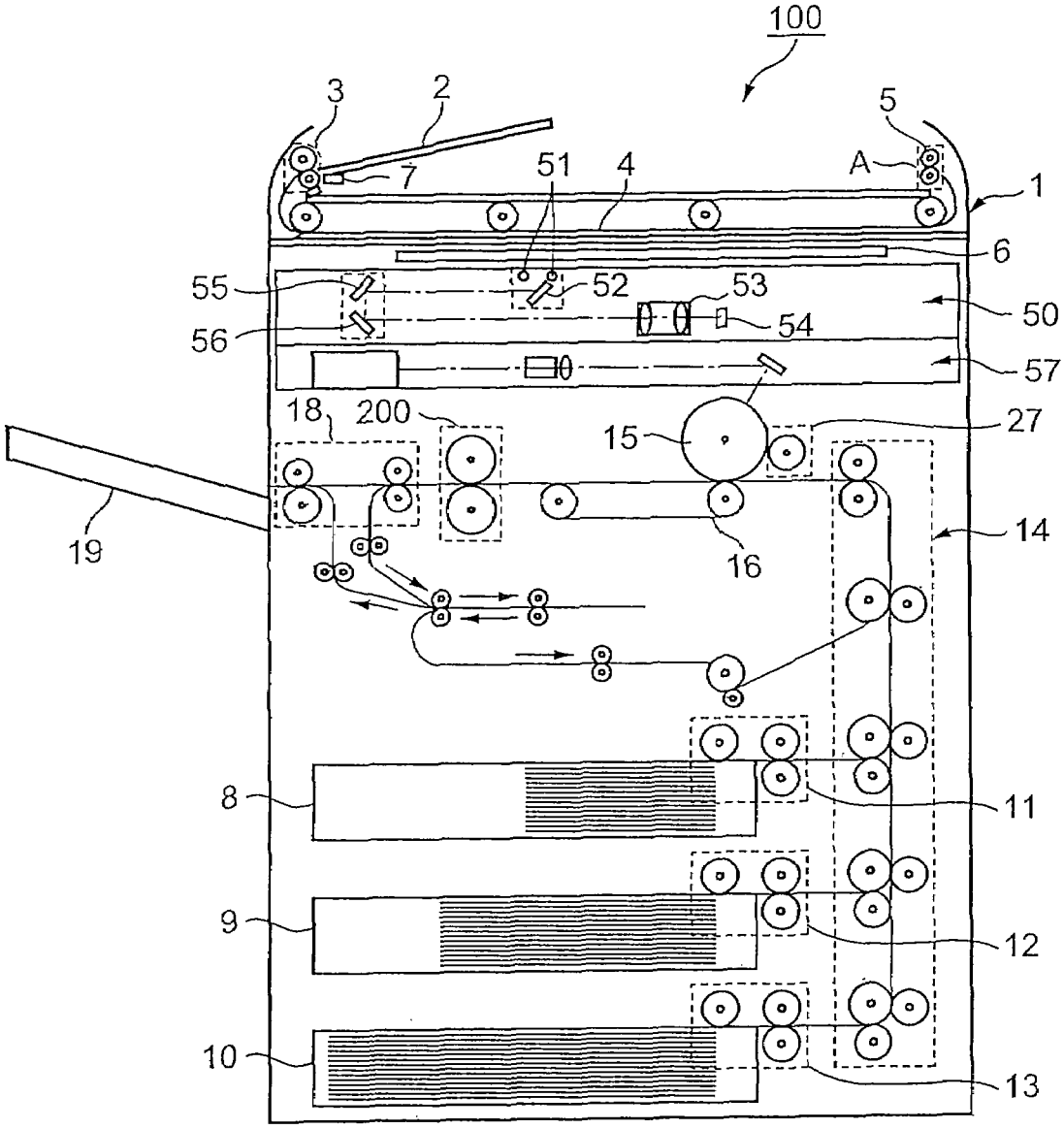
FIG. 1 is a diagram illustrating a digital copier 100 that includes one preferred embodiment of the fuser according to the current invention.

Referring now to the drawings, wherein like reference numerals designate corresponding structures throughout the views, and referring in particular to FIG. 1, a diagram illustrates a digital copier 100 that includes one preferred embodiment of the fuser according to the current invention. The digital copier 100 includes a contact glass 6 on a top surface. An automatic document feeder (ADF) 1 is located above the contact glass 6 and hinged at one end to cover or uncover the contact glass 6. The ADF 1 further includes a document feeding tray 2 for feeding a stack of documents as well as a separation/transfer means for separating one document at a time from the document stack and for transferring the separated single document towards a predetermined scanning position on the contact glass 6.

A paper supplying motor is activated by a central processing unit (CPU), which is not illustrated in FIG. 1, but included in the digital copier. The CPU activates the paper supplying motor in response to a paper supply activation signal. When the paper supplying motor is activated in a forward operation, the transfer rollers 3 rotate in a clockwise direction to feed a top sheet in the stack towards the contact glass 6. Upon detecting a leading edge of the fed top sheet at a document detection unit 7, the CPU activates the motor in a reverse operation to rotate the transfer rollers 3 in a counter-clockwise direction so as to prevent the feeding of other sheets in the stack. Upon detecting a trailing edge of the fed sheet at a document detection unit 7, the CPU counts a number of pulse signals for a transfer belt motor to a predetermined number. Then, the CPU deactivates the transfer belt 4 to place the fed sheet at the scanning position on the contact glass 6. Upon detecting a trailing edge of the fed sheet at a document detection unit 7, the CPU also reactivates the paper supplying motor to repeat the above described sequence to transfer a next sheet in the stack towards the predetermined scanning position. At the scanning position, the document is exposed by light and scanned by a scanner 50 in the copier 100. The scanner 50 further includes an exposing lamp 51, mirrors 52, 55 and 56, a lens 53 and a CCD 54. After scanning by the scanner 50, the separation/transfer means further transfers the document away from at the scanning position on the contact glass 6 via the transfer belt 4 to output rollers 5 and an output port A.

Still referring to FIG. 1, transfer paper is stored in a first tray 8, a second tray 9 and a third tray 10. The paper in the trays 8, 9 and 10 is respectively supplied to a first supplying unit 11, a second supplying unit 12 and a third supplying unit 13. The paper is subsequently transferred by a paper vertical transfer unit 14 to a predetermined position to physically contact a photoreceptor 15. An image that has been scanned by the scanning unit 50 is written on the photoreceptor 15 by laser from a writing unit 57. A developing unit 27 generates a toner image on the photoreceptor 15. While the image-transfer paper is further transferred by a transfer belt 16 at the same speed as the rotation of the photoreceptor 15, the toner image is transferred onto the image-transfer paper. The transferred toner image is fixed or fused on the image-transfer paper by a fuser 17. The image-transfer paper is finally outputted onto an output tray 19 by a paper output unit 18 unless it is stapled.

Figure 2:
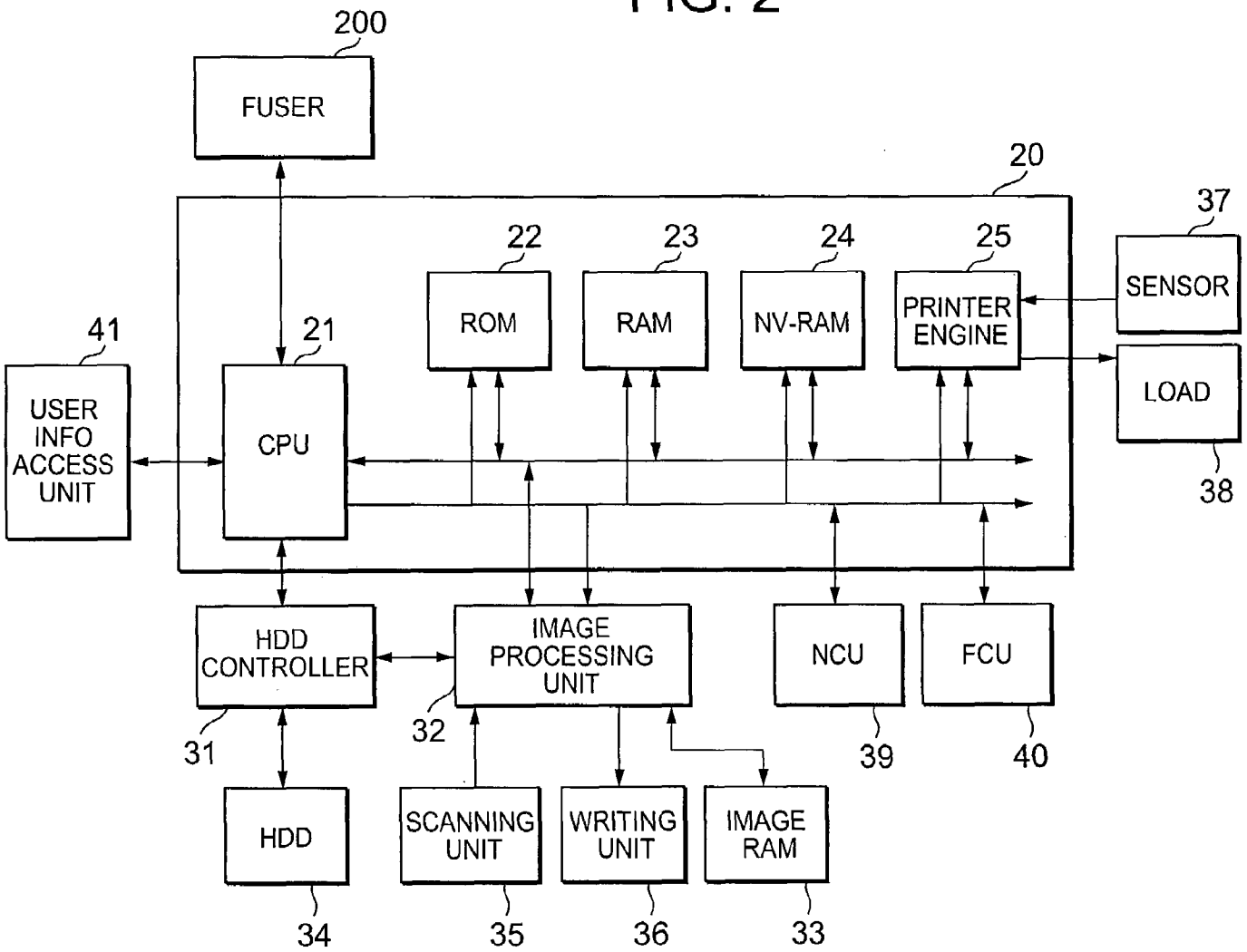
FIG. 2 is a block diagram illustrating a controller of the digital copier in one preferred embodiment according to the current invention.

Now referring to FIG. 2, a block diagram illustrates a controller 20 of the digital copier 100 in one preferred embodiment according to the current invention. The controller 20 further includes a central processing unit (CPU) 21, a read only memory (ROM) 22 for storing system programs for controlling the CPU 21, a random access memory (RAM) 23 to be used for a work area for application programs, a non-volatile random access memory (NV-RAM) 24 for safely storing adjusted numerical values for control, timing and copy mode in case of shut down or power outage, and an engine control 25 for controlling a load 38 based upon the input from the sensor 37. The access information including the operation panel, the ADF position and a document set to the ADF is inputted via the sensor 37. The CPU 21, the ROM 22, the RAM 23, the NV-RAM 24 and the engine 25 are all connected by a data and address bus.

Still referring to FIG. 2, the digital copier 100 also includes other units that are connected to the controller 20. The digital copier 100 further includes a network control unit (NCU) 39 for connecting to an external host and a facsimile control unit (FCU) 40 for realizing a facsimile function via a public circuit. An image processing unit 32 and a hard disk drive (HDD) controller 31 are also connected to the controller 20, and the image processing unit 32 is in turn connected to a scanning unit or scanner 35, a writing unit 36 and an image RAM 33. The HDD controller 31 is in turn connected to a hard disk drive (HDD) 34. Lastly, the CPU 21 is ultimately connected to a fuser or a fixing unit 200 of the image-forming device. The CPU 21 executes a selected one of various control software programs in the RAM 23 for controlling a fuser cleaning job sequence according to the current invention. The above fuser cleaning control software programs are optionally stored in the ROM 22 or a secondary storage that is accessed by the HDD 34. The digital copier 100 also includes a user information access unit 41 that is connected to the CPU 21 for obtaining a certain set of predetermined information that includes the document set information at the ADF, the opening-closing information of the ADF and the access information on the operation panel. The existence of any of the information generally indicates that the user has likely initiated a copy operation.

Figure 3:
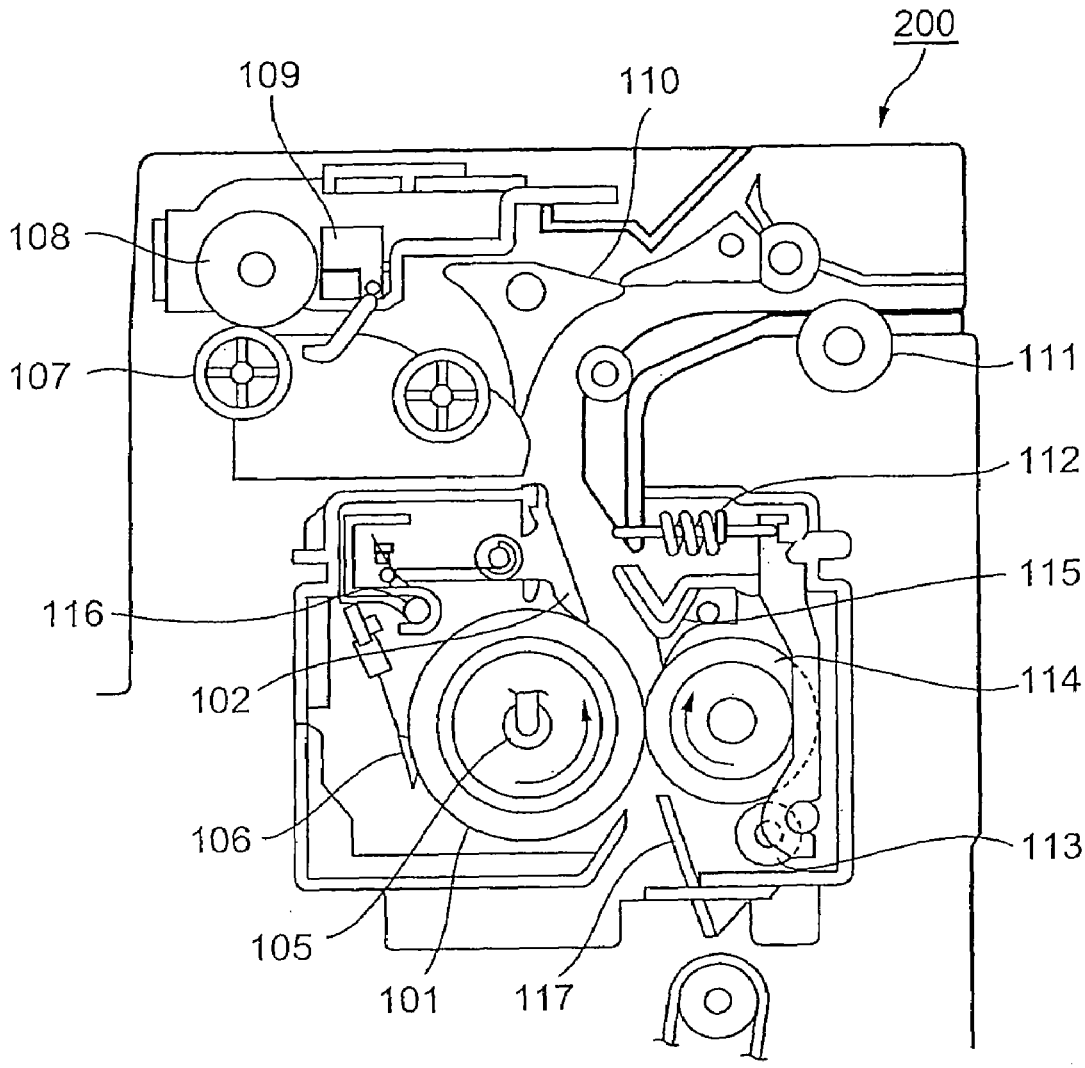
FIG. 3 is a diagram illustrating the fuser or the fixing unit in the image-forming device.

Now referring to FIG. 3, a diagram illustrates the fuser or the fixing unit 200 of the image-forming device. The fixing unit 200 further includes a fuser heater 105 such as a halogen heater, a fuser roller 101 that is heated by the fuser heater 105, a temperature sensor 106 for sensing the surface temperature of the fuser roller 101 and a temperature breaker or fuse 116 for shutting the power to the fuser heater 105 when the temperature sensor 106 registers a temperature beyond a predetermined temperature. The fixing unit 200 further includes a fuser separation pawl 102 for separating a transfer sheet from the fuser roller 101, a pressure roller 114 for applying a predetermined amount of pressure over the transfer paper by pressing against the fuser roller 101, a pressure separation pawl 115 for separating the transfer sheet from the pressure roller 114, a cleaning roller 113 for collecting toner from the pressure roller 114, a spring 112 for pressing the pressure roller 114, a delivery pawl 110 for controlling a direction of the fused transfer sheet, a first transferring roller 111 for transferring the fused transfer sheet, an output roller 108 for transferring the fused transfer sheet to an output, a second transferring roller 107 that passively rotates with the output roller 108, and an sheet output sensor 109 for detecting the transfer sheet delivery.

Still referring to FIG. 3, an operation of the fuser 200 will be described in the following. Upon entering via an entry guide plate 117, the transfer sheet faces its toner image on the fuser roller 101. The fusing roller 101 and the pressure roller 114 rotate together as indicated by arrows. As a leading edge of the transfer paper arrives the fuser roller 101, the toner image on the transfer sheet is fixed by melting the toner. The heat source for melting the toner is provided by the internal fuser heater 105 that is located inside the fuser roller 101. The internal fuser heater 105 is controlled based upon the temperature that is measured by the temperature sensor 106 so as to maintain the surface on the fuser roller 101 at a uniform temperature. As the trailing edge of the transfer paper is detected by the output sensor 109, the fusing or fixing process is completed.

In the prior art, the cleaning roller 113 has collected the residual toner on the fuser roller 101 via the pressure roller 114 during the above described fusing operations. This collection or cleaning technique is largely passive and not active for cleaning the residual toner on the fuser roller 101 during the fusing operation. During the fusing operation, residual toner is partially collected by the pressure roller 114 and the fuser separation pawl 102. The pressure roller 114 collects the residual toner since its surface has a stronger surface adhesiveness and a lower temperature than the surface of the fuser roller 101. Due to these characteristics, the residual toner on the fuser roller 101 is transferred onto the pressure roller 114. By the same token, the cleaning roller 113 has a stronger surface adhesiveness and a lower temperature than the surface of the pressure roller 114. Thus, the residual toner on the pressure roller 114 is transferred onto the cleaning roller 113 and is ultimately collected into a predetermined location.

However, since the above passive cleaning is performed during the fusing operation in prior art, the fuser roller 101 is partially covered by the image-transfer sheet and the residual toner is not sufficiently cleaned. At the end of each fusing operation, the uncollected residual toner remains on the fuser roller 101 and or the fuser separation pawl 102 in a gel state due to the heat from the fuser heater 105. Before a next round of the fusing operation, if there is a sufficient amount of time for the fuser roller 101 to cool down, the residual toner on the fuser roller 101 and or the fuser separation pawl 102 is solidified. During the next round of the fusing operation, the solidified the residual toner falls off from the fuser roller 101 and or the fuser separation pawl 102 onto the image-transfer paper to cause the undesired effect as described before.

According to the current invention, the residual toner cleaning or collection operation is performed before and or after a fusing operation. In other words, the fuser roller 101, the pressure roller 114 and the cleaning roller 113 are rotated at a predetermined temperature for a predetermined amount of time prior and or subsequent to the fusing operation without the image-transfer sheet. The pre-/post-fusing rotation is preferably immediately before and after the fusing operation. The amount of time for the pre-/post-fusing rotation depends upon many factors including a number of fused sheets between cleaning processes and the size of image area on the fused sheets. In addition, the temperature during the pre-/post-fusing rotation is preferably lower than that during the fusing operation. The lower temperature facilitates the cleaning process since the residual toner becomes more adhesive. During the pre-/post-fusing rotation, the residual toner is substantially cleaned from the fuser roller 101 since the image-transfer paper is not obstructing the fuser roller surface. The cleaned residual toner is ultimately collected into a predetermined receptacle via the pressure roller 114 and the cleaning roller 113.

Figure 4:
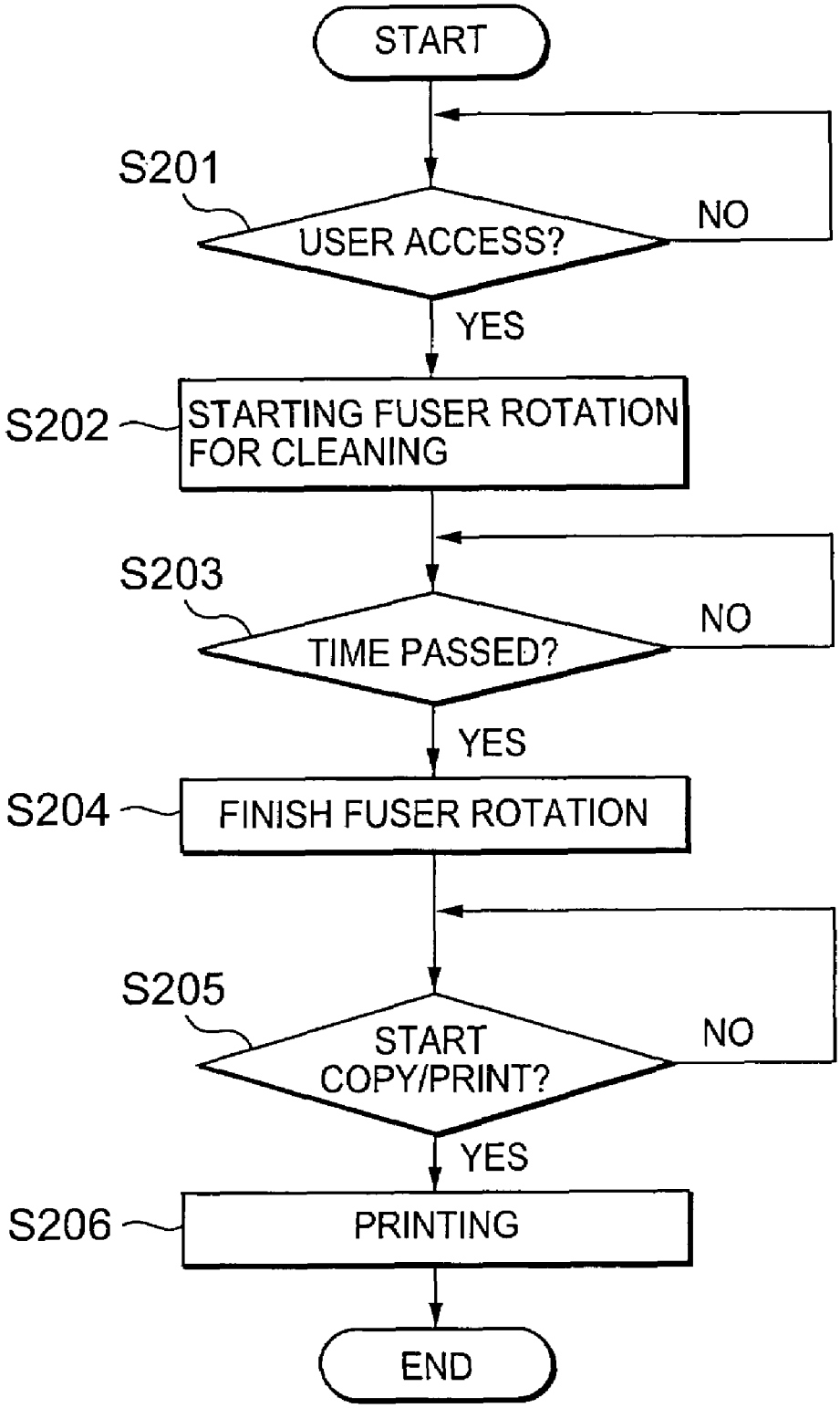
FIG. 4 is a flow chart illustrating steps involved in a first preferred process of actively collecting the residual toner on a fuser roller according to the current invention.

Now referring to FIG. 4, a flow chart illustrates steps involved in a first preferred process of actively collecting the residual toner on a fuser roller according to the current invention. In a step S201, it is continuously determined whether or not any of the predetermined user access information has been obtained in the user information access unit 41. The predetermined accessed information includes the document set information at the ADF, the opening-closing information of the ADF and the access information on the operation panel. The existence of any of the information generally indicates that the user has likely initiated a copy operation. If none of the information is polled, the first preferred process waits in the step S201. On the other hand, if it is determined in the step S201 any of the information is obtained, since it is sufficiently expected that a copy operation will be initiated, the copy engine activates the rotation of the fuser roller 101 based upon the above access information as a trigger in a step S202. During the rotation, the residual toner on the fuser roller 101 is removed by the fuser separation pawl 102, and the removed toner stays on the fuser separation pawl 102. It is further determined in a step S203 whether or not a predetermined amount of time has passed since the activation of the fuser roller 101 in the step S203. If it is determined in the step S203 that the predetermined amount of time has not elapsed, the rotation is maintained for a pre-cleaning operation.

Still referring to FIG. 4, if it is determined in the step S203 that the predetermined amount of time has elapsed, the rotation is discontinued in a step S204 for the pre-cleaning operation. During the rotation of the fuser roller 101, the removed residual toner physically falls off the fuser separation pawl 102. Subsequently, since the cleaning roller 113 and the pressure roller 114 are simultaneously rotated for a predetermined amount of time between the steps S202 and S204 to collect the removed residual toner. The removed residual toner is transferred to a predetermined collection area by the cleaning roller 113 via the pressure roller 114. Furthermore, it is determined if a user has activated a copy/print operation in a step S206. If no copy/print operation is found in the step S206, the first preferred process waits in the step S206. On the other hand, if it is determined in the step S206 that the user initiates a copy/print operation, the preferred process initiates the copy/print operation in the step S207 after the fuser roller 101 has been cleaned. In the above steps S202 and S203, the cleaning operation is performed for the predetermine amount of time in the preferred process. In an alternative process, the cleaning operation is repeated for a predetermined number of rotations of the fuser roller 101 and or the cleaning roller 113.

Figure 5:
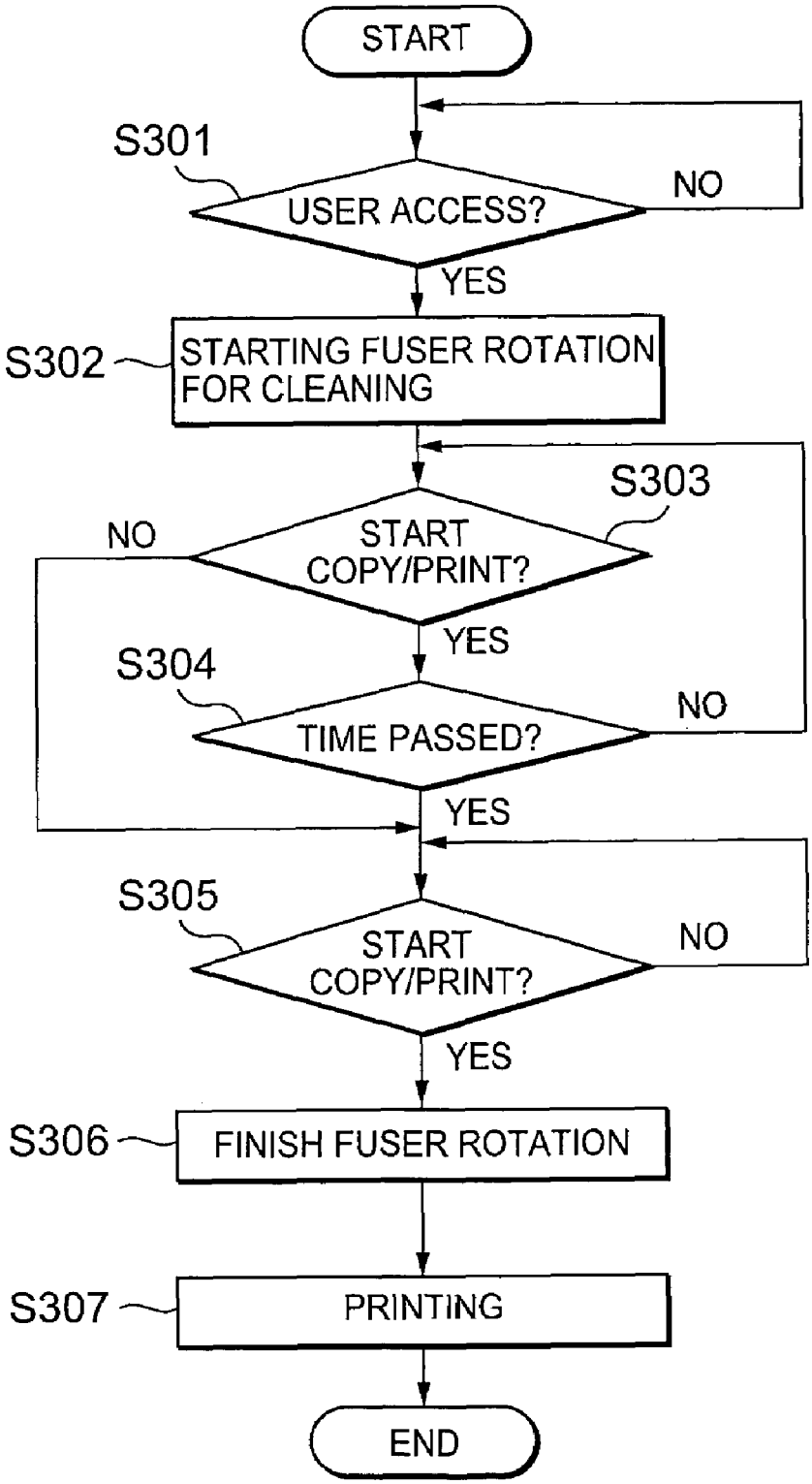
FIG. 5 is a flow chart illustrating steps involved in a second preferred process of actively collecting the residual toner on a fuser roller according to the current invention.

Now referring to FIG. 5, a flow chart illustrates steps involved in a second preferred process of actively collecting the residual toner on a fuser roller according to the current invention. In a step S301, it is continuously determined whether or not any of the predetermined user access information has been obtain in the system. The predetermined accessed information includes the document set information at the ADF, the opening-closing information of the ADF and the access information on the operation panel. The existence of any of the information generally indicates that the user has likely initiated a copy operation. If none of the information is polled, the second preferred process waits in the step 301. On the other hand, if it is determined in the step S301 any of the information is obtained, since it is sufficiently expected that a copy operation will be initiated, the copy engine activates the rotation of the fuser roller 101 based upon the above access information as a trigger in a step S302. During the rotation in the step S302, the residual toner on the fuser roller 101 is removed by the fuser separation pawl 102, and the removed toner stays on the fuser separation pawl 102. After the above initiated rotation, it is determined in a step S303 if a user has activated a copy/print operation. If no copy/print operation is found in the step S303, the second preferred process proceeds to a step S305. On the other hand, if it is determined in the step S303 that the user has initiated a copy/print operation, it is further determined in a step S304 whether or not a predetermined amount of time has passed since the activation of the fuser roller 101 in the step S302.

Still referring to FIG. 5, if it is determined in the step S304 that the predetermined amount of time has not elapsed, the rotation is maintained and the second preferred process returns to the step S303. On the other hand, if it is determined in the step S304 that the predetermined amount of time has elapsed, it is further determined in the step S305 if a user has activated a copy/print operation. If no copy/print operation is found in the step S305, the second preferred process waits in the step S305. On the other hand, if it is determined in the step S305 that the user has already initiated a copy/print operation, the rotation of the fuser roller 101 is discontinued in a step S306 for the pre-cleaning operation. While the fuser roller 101 is rotating, the removed residual toner physically falls off the fuser separation pawl 102. Subsequently, since the cleaning roller 113 and the pressure roller 114 are simultaneously rotated for at least a predetermined amount of time between the steps S302 and S306 to collect the removed residual toner, the removed residual toner is transferred to a predetermined collection area by the cleaning roller 113 via the pressure roller 114. Furthermore, the second preferred process initiates the copy/print operation in the step S308 after the fuser roller 101 has been cleaned. As described above, the second preferred process ascertains that the pre-cleaning operation is completed even if a user interrupts with the copy/print operation. In the above steps, the cleaning operation is performed for the predetermine amount of time in the second preferred process. In an alternative process, the cleaning operation is repeated for a predetermined number of rotations of the fuser roller 101 and or the cleaning roller 113.

Figure 6:
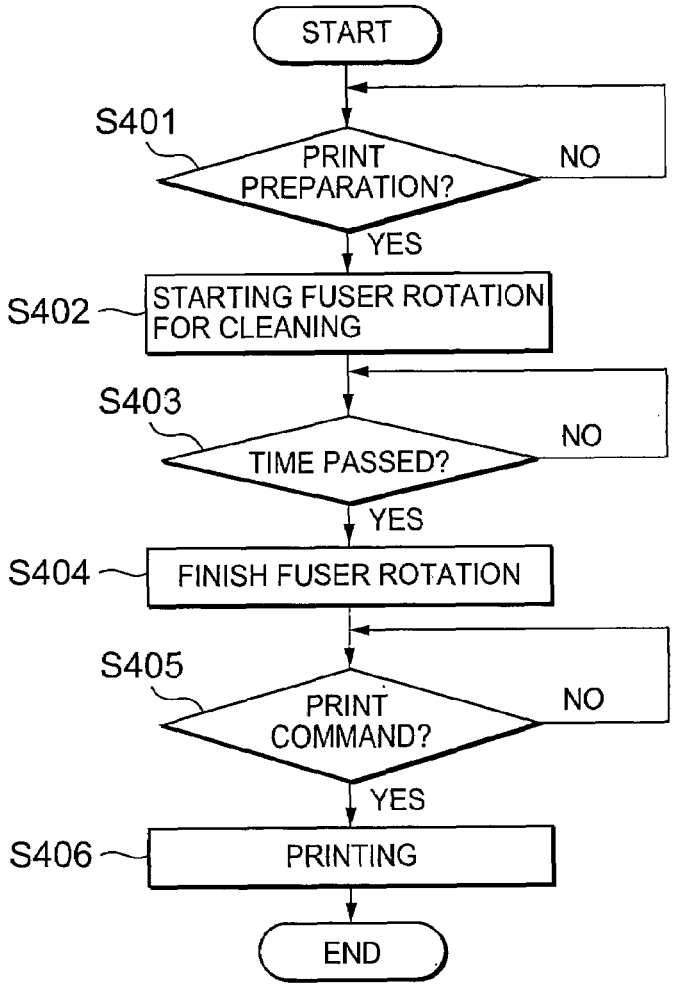
FIG. 6 is a flow chart illustrating steps involved in a third preferred process of actively collecting the residual toner on a fuser roller according to the current invention.

Now referring to FIG. 6, a flow chart illustrates steps involved in a third preferred process of actively collecting the residual toner on a fuser roller according to the current invention. In a step S401, it is continuously determined whether or not a print preparation command has been issued. The print preparation command is initiated for printing or faxing a document. If it is determined in the step S401 that the print preparation command has not been issued, the third preferred process waits at the step S401. On the other hand, if it is determined in the step S401 that the print preparation command has been issued, the third preferred process proceeds to a step S402. When the CPU receives a print request from an external host via the NCU 39 or a fax receiving request via the FCU 40, the CPU issues a printer preparation command for activating a polygon motor to the print engine 25. The issuance of the print preparation command generally indicates that the print operation is likely to occur. Since it is sufficiently expected that the print operation will be initiated, the copy engine activates the rotation of the fuser roller 101 based upon the above information as a trigger in a step S402. During the rotation in the step S402, the residual toner on the fuser roller 101 is removed by the fuser separation pawl 102, and the removed toner stays on the fuser separation pawl 102. It is further determined in a step S403 whether or not a predetermined amount of time has passed since the activation of the fuser roller 101 in the step S402.

Still referring to FIG. 6, if it is determined in the step S403 that the predetermined amount of time has not elapsed, the rotation is maintained for a pre-cleaning operation. On the other hand, if it is determined in the step S403 that the predetermined amount of time has elapsed, the rotation is discontinued in a step S404 for the pre-cleaning operation. During the rotation of the fuser roller 101, the removed residual toner physically falls off the fuser separation pawl 102. Subsequently, since the cleaning roller 113 and the pressure roller 114 are simultaneously rotated for a predetermined amount of time between the steps S402 and S404 to collect the removed residual toner, the removed residual toner is transferred to a predetermined collection area by the cleaning roller 113 via the pressure roller 114. Furthermore, it is determined if a print command is issued in a step S406. If no print command is found in the step S406, the preferred process waits in the step S406. On the other hand, if it is determined in the step S406 that the print command has been issued, the third preferred process initiates the print operation in a step S407 after the fuser roller 101 has been cleaned. In the above steps, the cleaning operation is performed for the predetermine amount of time in the third preferred process. In an alternative process, the cleaning operation is repeated for a predetermined number of rotations of the fuser roller 101 and or the cleaning roller 113.

Figure 7:
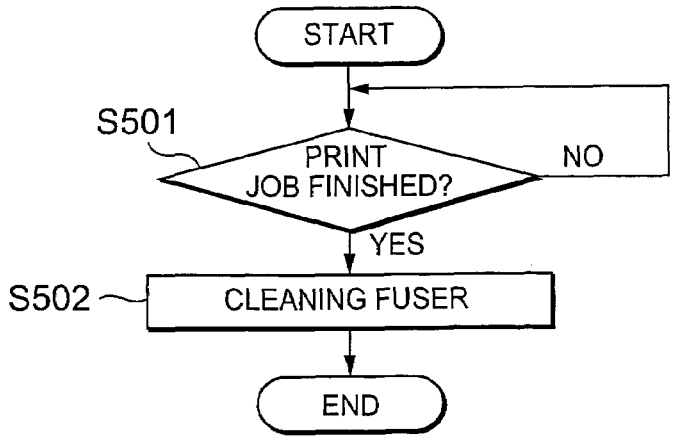
FIG. 7 is a flow chart illustrating steps involved in a fourth preferred process of actively collecting the residual toner on a fuser roller according to the current invention.

Now referring to FIG. 7, a flow chart illustrates steps involved in a fourth preferred process of actively collecting the residual toner on a fuser roller according to the current invention. In a step S501, it is continuously determined whether or not a print job has been completed. If it is determined in the step S501 that the print job has not been completed, the fourth preferred process waits at the step S501. On the other hand, if it is determined in the step S501 that the print job has been completed, the fourth preferred process proceeds to a step S502, where the above described steps associated with cleaning of the fuser 200 are performed. The fourth preferred process cleans the fuser 200 after each of the print job rather than before the print job in order to reduce a print response time after a user issues a print command. Although as described above, the fuser cleaning steps are performed in response to a print-related command or a predetermined information access in the anticipation of a print job in some of the preferred process, the print response time may be still affected. The fourth preferred process substantially eliminates an undesirable effect of the fuser cleaning steps on the print response time.

Figure 8:
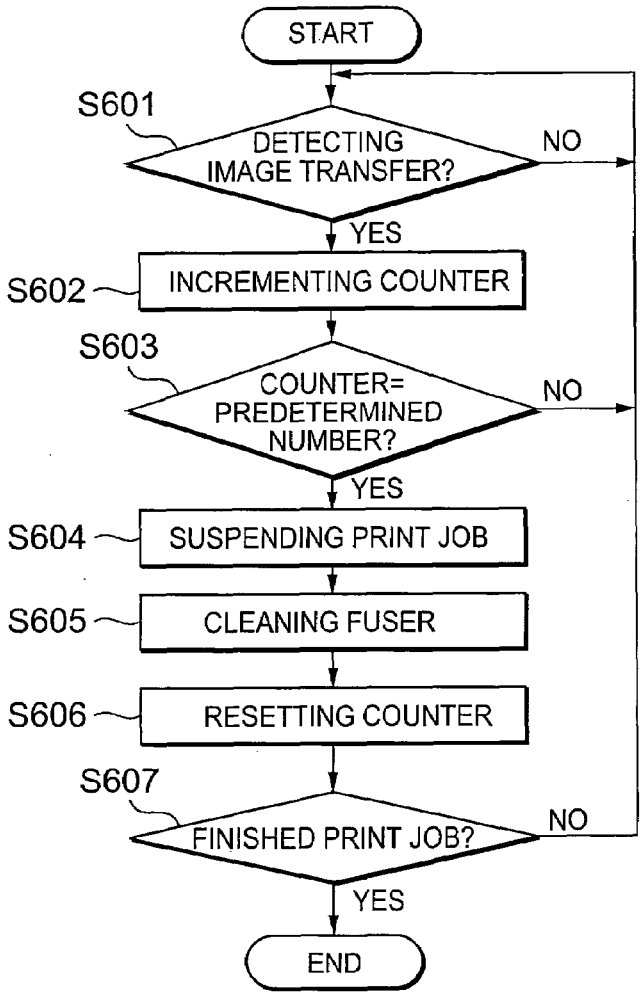
FIG. 8 is a flow chart illustrating steps involved in a fifth preferred process of actively collecting the residual toner on a fuser roller according to the current invention.

Now referring to FIG. 8, a flow chart illustrates steps involved in a fifth preferred process of actively collecting the residual toner on a fuser roller according to the current invention. In a step S601, it is continuously determined whether or not a trailing end of the image-transfer sheet has been detected at a predetermined location in a printing path. If it is determined in the step S601 that the image-transfer sheet has not been detected, the fifth preferred process waits at the step S601. On the other hand, if it is determined in the step S601 that the image-transfer sheet has been detected, the fifth preferred process proceeds to a step S602, where a predetermined counter is incremented by one for recording an additional sheet that has been fused. After the increment, it is determined in a step S603 whether or not the counter value has reached a predetermined number of sheets. If the counter value has not reached a predetermined number of sheets, the fifth preferred process returns to the step S601. On the other hand, if the counter value has reached a predetermined number of sheets, the current and future print jobs will be suspended in the future in a step S604 until a fuser cleaning job initiated in a step S605 is completed. The fuser cleaning job includes that the fuser roller 101, the pressure roller 114 and the cleaning roller 113 are rotated at a predetermined temperature for a predetermined amount of time subsequent to the fusing operation without the image-transfer sheet as described with respect to FIG. 3. Upon completing the fuser cleaning job, the counter is reset in the step S606. Because of the print suspension, it is further determined in a step S607 whether or not print jobs are completed. If it is not completed, the fifth preferred embodiment returns to the step S601 to repeat the steps. Otherwise, the fifth preferred embodiment terminates. The fifth preferred process prolongs the life of the fuser 200 by minimizing the number of unnecessary cleanings. The pre-cleaning step 605 is performed only after a predetermined number of image-transfer sheets is fused at the fuser 200.

Figure 9:
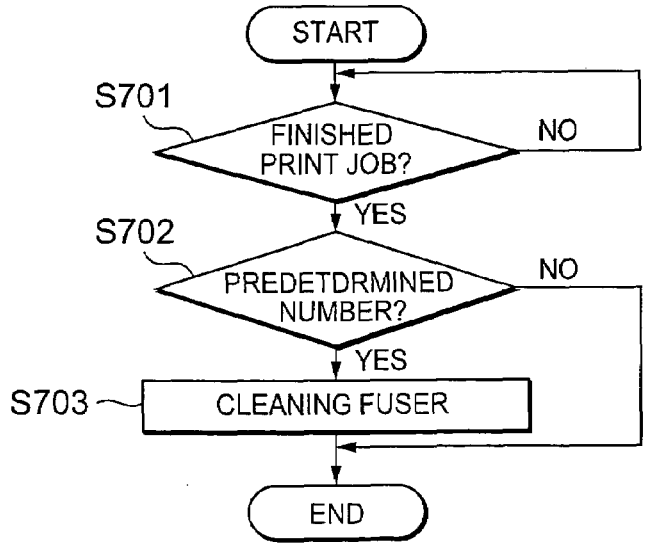
FIG. 9 is a flow chart illustrating steps involved in a sixth preferred process of actively collecting the residual toner on a fuser roller according to the current invention.

Now referring to FIG. 9, a flow chart illustrates steps involved in a sixth preferred process of actively collecting the residual toner on a fuser roller according to the current invention. In a step S701, it is continuously determined whether or not a print job has been completed. If it is determined in the step S701 that the print job has not been completed, the sixth preferred process waits at the step S701. On the other hand, if it is determined in the step S701 that the print job has been completed, the sixth preferred process proceeds to a step S702, it is further determined in a step S702 whether or not the counter value has reached a predetermined number of sheets. If the counter value has not reached a predetermined number of sheets, the sixth preferred process terminates. On the other hand, if the counter value has reached a predetermined number of sheets in the step S702, the fuser 200 is cleaned in a step S703. The fuser cleaning in the step S703 includes that the fuser roller 101, the pressure roller 114 and the cleaning roller 113 are rotated at a predetermined temperature for a predetermined amount of time subsequent to the fusing operation without the image-transfer sheet as described with respect to FIG. 3. The sixth preferred process cleans the fuser 200 after each of the print job rather than before the print job in order to reduce a print response time after a user issues a print command. Although as described above, the fuser cleaning steps are performed in response to a print-related command or a predetermined information access in the anticipation of a print job in some of the preferred process, the print response time may be still affected. The sixth preferred process substantially eliminates an undesirable effect of the fuser cleaning steps on the print response time.

Figure 10:
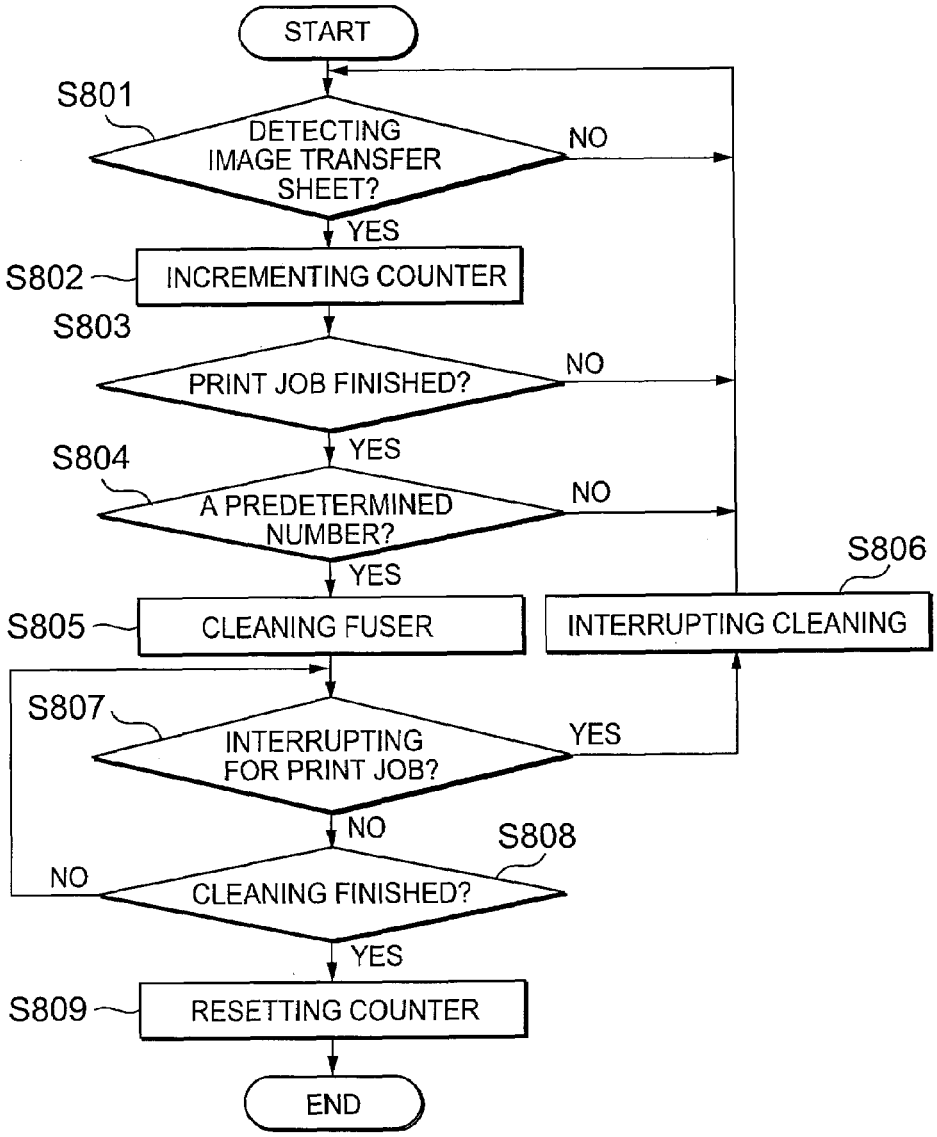
FIG. 10 is a flow chart illustrating steps involved in a seventh preferred process of actively collecting the residual toner on a fuser roller according to the current invention.

Now referring to FIG. 10, a flow chart illustrates steps involved in a seventh preferred process of actively collecting the residual toner on a fuser roller according to the current invention. In a step S801, it is continuously determined whether or not a trailing end of the image-transfer sheet has been detected by the sheet output sensor 109 at a predetermined location in a printing path. If it is determined in the step S801 that the image-transfer sheet has not been detected, the seventh preferred process waits at the step S801. On the other hand, if it is determined in the step S801 that the image-transfer sheet has been detected, the seventh preferred process proceeds to a step S802, where a predetermined counter in the NV-RAM 24 is incremented by one for recording an additional sheet that has been fused. After the increment, it is determined in a step S803 whether or not the print job has finished. If it is determined in the step S803 that the print job has not finished, the seventh preferred process returns to the step S801. On the other hand, if it is determined in the step S803 that the print job has finished, it is further determined in a step S804 whether or not the counter value has reached a predetermined number of sheets. If the counter value has not reached a predetermined number of sheets, the seventh preferred process returns to the step S801. On the other hand, if the counter value has reached a predetermined number of sheets, a fuser cleaning job is initiated in a step S805. The fuser cleaning job includes that the fuser roller 101, the pressure roller 114 and the cleaning roller 113 are rotated at a predetermined temperature for a predetermined amount of time subsequent to the fusing operation without the image-transfer sheet as described with respect to FIG. 3.

Still referring to FIG. 10, upon completing the fuser cleaning job, the seventh preferred process further determines in a step S807 whether or not a print job has interrupted. In case of the print job interrupt as found in the step S807, the seventh preferred process also interrupts any on-going cleaning job in a step S806 and returns to the step S801. On the other hand, if it is determined in the step S807 that no print job interrupts, it is further determined in a step S808 whether or not the current fuser cleaning job has finished. In case the fuser cleaning job has not yet finished, the seventh preferred process returns to the step S807. In case the fuser cleaning is complete, the seventh preferred process resets the counter in a step S809 and terminates. The seventh preferred process prolongs the life of the fuser 200 by minimizing the number of unnecessary cleanings. The pre-cleaning step 805 is performed only after a predetermined number of image-transfer sheets is fused at the fuser 200. The seventh preferred process also a print job to be executed during the fuser cleaning by interrupting the fuser cleaning job in order to increase the print productivity. If power is interrupted during the fuser cleaning job, since the fuser cleaning job does not terminate normally, the counter value is not cleared to avoid any erroneous cleaning job.

For example, the above described first through seventh preferred processes are implemented as a control software program. The CPU 21 executes a selected one of the control software programs in the RAM 23 for controlling a fuser cleaning job sequence according to the current invention. The above fuser cleaning control software programs are optionally stored in the ROM 22 or a secondary storage that is accessed by the HDD 34. In alternative implementation, the above described first through seventh preferred processes are implemented as a hardware unit.

Figure 11:
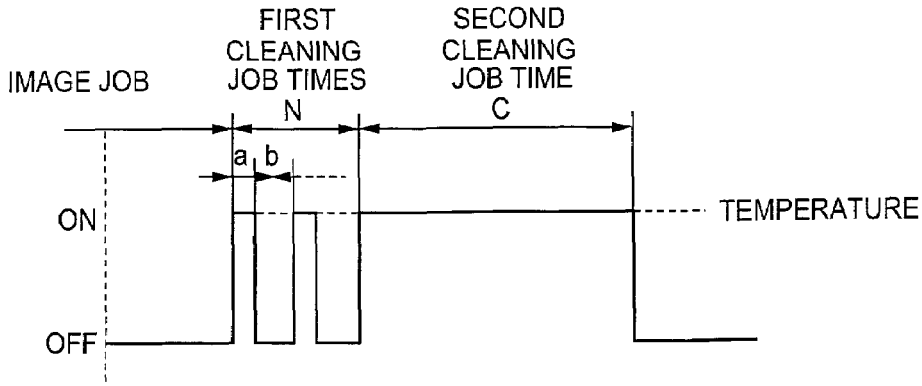
FIG. 11 is a graph illustrating parameters for the fuser cleaning job to be performed in the above described preferred processes according to the current invention.

Now referring to FIG. 11, a graph illustrates parameters for the fuser cleaning job to be performed in the above described preferred processes according to the current invention. The y axis indicates whether or not the fuser cleaning job is on or off while the x axis indicates duration in time. In this exemplary sequence, immediately following an image-forming or print job, a first exemplary cleaning job is illustrated. During the first cleaning job, the fuser is turned on and off a predetermine number of times N. After the fuser is activated to rotate without any image-transfer sheet for a first predetermined period a, it is deactivated for a second predetermined period b for physically separating the collected residual toner from the fuser separation pawl 102. In this example, the activation period a is shorter than the deactivation period b, and the surface temperature on the fuser is maintained at a certain temperature. Following a predetermined number n of the burst or intermittent activations, the fuser is continuously activated for a predetermined amount of time C. Any combination of the above two activation patterns is practiced as the fuser cleaning job in a preferred process according to the current invention. In other words, the parameters a, b, C and N are optionally varied. Furthermore, although in the above example, the fuser cleaning takes place immediately subsequent to a print job, the relative relation between the fuser cleaning job and the print job is optionally changed in alternative processes.

It is to be understood, however, that even though numerous characteristics and advantages of the present invention have been set forth in the foregoing description, together with details of the structure and function of the invention, the disclosure is illustrative only, and that although changes may be made in detail, especially in matters of shape, size and arrangement of parts, as well as implementation in software, hardware, or a combination of both, the changes are within the principles of the invention to the full extent indicated by the broad general meaning of the terms in which the appended claims are expressed.

What is claimed is:

1. A method of cleaning a fuser in an image-forming device, comprising the steps of:

anticipating a print operation in the image-forming device to generate a print preparation command;

cleaning residual toner from the fuser in response to the print preparation command prior to forming an image on an image-transfer sheet in the image-forming device by intermittently activating and deactivating for a predetermined number of times to rotate a fuser roller in the fuser and collecting the residual toner;

forming the image on the image-transfer sheet; and fusing the image on the image-transfer sheet at a first predetermined temperature.

2. The method of cleaning a fuser in an image-forming device according to claim 1 wherein said cleaning step further comprises additional steps of:

rotating a fuser roller in the fuser for a predetermined amount of time; and collecting the residual toner.

3. The method of cleaning a fuser in an image-forming device according to claim 1 wherein said cleaning step further comprises additional steps of:

intermittently rotating a fuser roller in the fuser for a predetermined number of times;

rotating a fuser roller in the fuser for a predetermined amount of time; and collecting the residual toner.

4. The method of cleaning a fuser in an image-forming device according to claim 1 wherein said cleaning step further comprises additional steps of:

rotating a fuser roller in the fuser for a predetermined amount of time;

intermittently rotating a fuser roller in the fuser for a predetermined number of times; and collecting the residual toner.

5. The method of cleaning a fuser in an image-forming device according to claim 2, 3 or 4 wherein said collecting step further comprises additional step of activating a pressure roller and a cleaning roller for a predetermined amount of time for collecting the residual toner.

6. The method of cleaning a fuser in an image-forming device according to claim 5 wherein the fuser roller, the pressure roller and the cleaning roller are simultaneously rotated.

7. The method of cleaning a fuser in an image-forming device according to claim 5 wherein said cleaning step is performed at a second predetermined temperature that is lower than the first predetermined temperature.

8. The method of cleaning a fuser in an image-forming device according to claim 1 wherein said cleaning step is interrupted by said forming step of forming the image.

9. The method of cleaning a fuser in an image-forming device according to claim 1 wherein said forming step of forming the image is suspended during said cleaning step.

10. The method of cleaning a fuser in an image-forming device according to claim 1 wherein the print preparation command is generated when one of a predetermined set of information on the image-forming device is accessed.

11. A system for cleaning a fuser in an image-forming device, comprising:

a fuser for fusing an image on an image-transfer sheet at a first predetermined temperature;

a user information access unit for obtaining a predetermined set of information to anticipate a print operation in the image-forming device so as to generate a print preparation command;

a control unit connected to said user information access unit and said fuser for controlling a cleaning sequence for cleaning residual toner from said fuser in response to the print preparation command prior to fusing an image on an image-transfer sheet in said fuser, said control unit generating a cleaning complete signal upon finishing the cleaning sequence;

a writing unit connected to said control unit for forming the image on the image-transfer sheet in response to the cleaning complete signal, wherein said fuser fuses the image on the image-transfer sheet after the cleaning sequence, wherein said fuser further comprises a fuser roller, said control unit activating and deactivating said fuser for a predetermined number of times for intermittently rotating said fuser roller in said fuser in order to collect the residual toner.

12. The system for cleaning a fuser in an image-forming device according to claim 11 wherein said fuser further comprises a fuser roller, said control unit activating said fuser for rotating said fuser roller for a predetermined amount of time in order to collect the residual toner.

13. The system for cleaning a fuser in an image-forming device according to claim 11 wherein said fuser further comprises a fuser roller, said control unit activating said fuser for intermittently rotating said fuser roller for a predetermined number of times and for additionally rotating said fuser roller for a predetermined amount of time to collect the residual toner.

14. The system for cleaning a fuser in an image-forming device according to claim 11 wherein said fuser further comprises a fuser roller, said control unit activating said fuser for rotating said fuser roller for a predetermined amount of time and for additionally and intermittently rotating said fuser roller for a predetermined number of times to collect the residual toner.

15. The system for cleaning a fuser in an image-forming device according to claim 12, 13 or 14 wherein said fuser further comprises a pressure roller and a cleaning roller, said control unit simultaneously activating to rotate said fuser roller, said pressure roller and said cleaning roller for a predetermined amount of time for collecting the residual toner.

16. The system for cleaning a fuser in an image-forming device according to claim 15 wherein the cleaning sequence is performed at a second predetermined temperature that is lower than the first predetermined temperature.

17. The system for cleaning a fuser in an image-forming device according to claim 11 wherein said control unit interrupts the cleaning sequence when said printer engine forms the image on the image-transfer sheet.

18. The system for cleaning a fuser in an image-forming device according to claim 11 wherein said control unit suspends said printer engine from forming the image during the cleaning sequence.

19. The system for cleaning a fuser in an image-forming device according to claim 11 wherein said user information access unit generates the print preparation command when one of a predetermined set of information on the image-forming device is accessed.

* * * * *